US007487890B2

(12) United States Patent
Holm

(10) Patent No.: US 7,487,890 B2
(45) Date of Patent: Feb. 10, 2009

(54) APPARATUS AND SYSTEM FOR DISPENSING A PRODUCT

(76) Inventor: Rodger Holm, 782 Stemple Pass Rd., Gehring Ranch, Lincoln, MT (US) 59639

( * ) Notice: Subject to any disclaimer, the term of this patent is extended or adjusted under 35 U.S.C. 154(b) by 567 days.

(21) Appl. No.: 11/087,137

(22) Filed: Mar. 22, 2005

(65) Prior Publication Data

US 2005/0229973 A1 Oct. 20, 2005

Related U.S. Application Data

(60) Provisional application No. 60/555,239, filed on Mar. 22, 2004.

(51) Int. Cl.
*F16L 5/00* (2006.01)

(52) U.S. Cl. ..... 222/148; 222/105; 222/380; 141/91

(58) Field of Classification Search ..... 222/92, 222/93, 105, 148, 380; 141/89–91
See application file for complete search history.

(56) References Cited

U.S. PATENT DOCUMENTS

| | | | | | |
|---|---|---|---|---|---|
| 1,841,275 | A | | 1/1932 | Baptiste | |
| 1,965,833 | A | * | 7/1934 | Geddes | 222/145.7 |
| 2,000,910 | A | | 5/1935 | Appel et al. | 15/137 |
| 2,656,966 | A | * | 10/1953 | McDonough et al. | 141/91 |
| 2,670,114 | A | * | 2/1954 | Dobbins | 141/91 |
| 2,771,219 | A | | 11/1956 | Dewey | 222/93 |
| 2,792,856 | A | | 5/1957 | Coppage | 141/362 |
| 3,105,612 | A | | 10/1963 | Krasnoff et al. | 222/78 |
| 3,417,902 | A | * | 12/1968 | Mirka | 222/96 |
| 3,613,698 | A | | 10/1971 | Fox | 132/84 |
| 3,860,147 | A | | 1/1975 | Vessio et al. | 222/96 |
| 4,019,655 | A | * | 4/1977 | Moeller | 222/96 |
| 4,223,809 | A | * | 9/1980 | Martin | 222/96 |
| 4,303,110 | A | | 12/1981 | Chen | 141/362 |
| D267,060 | S | | 11/1982 | Iwamoto | D6/87 |
| 4,508,240 | A | | 4/1985 | Arango | 222/96 |
| 4,570,829 | A | | 2/1986 | Allen | 222/181 |
| 4,600,126 | A | | 7/1986 | Arango | 222/82 |
| 5,103,560 | A | | 4/1992 | Podolsky | 30/41 |
| 5,482,187 | A | | 1/1996 | Poulsen et al. | 222/207 |
| 5,573,138 | A | * | 11/1996 | Lin | 222/96 |
| 6,027,273 | A | | 2/2000 | Li | 401/190 |

FOREIGN PATENT DOCUMENTS

| | | |
|---|---|---|
| DE | 3712802 | 6/1988 |

* cited by examiner

*Primary Examiner*—J. Casimer Jacyna
(74) *Attorney, Agent, or Firm*—Kunzler & McKenzie

(57) ABSTRACT

An apparatus and system are disclosed for dispensing a product such as toothpaste. The apparatus includes a body; an actuator, slideably connected to the body, and configured to open a gate to dispense a product; a nozzle configured to wet the gate with a fluid in response to movement of the actuator; and a fluid source coupled to the nozzle. A system for dispensing product is also presented. The system includes a body; an actuator slideably connected to the body, and configured to open a gate to dispense a product; a nozzle configured to wet the gate with fluid in response to movement of the actuator; a fluid source coupled to the nozzle; a piston configured to discharge the product; and a pump configured to draw fluid from the fluid source to wet the gate.

18 Claims, 10 Drawing Sheets

APPARATUS AND SYSTEM FOR DISPENSING A PRODUCT

CROSS-REFERENCES TO RELATED APPLICATIONS

This application claims benefit of U.S. Provisional Patent Application No. 60/555,239 entitled "Toothpaste Dispenser" and filed on Mar. 22, 2004 for Rodger Holm, which is incorporated herein by reference.

BACKGROUND OF THE INVENTION

1. Field of the Invention

The invention relates to an apparatus for drawing a viscous product such as toothpaste from a container and dispensing the product. More particularly this invention relates to a product dispenser with a vacuum pump of piston-cylinder construction.

2. Description of the Related Art

Viscous products such as toothpaste have historically been dispensed from flexible tubes. When the tube is squeezed the product is extruded from a nozzle at the end of the tube. Dispensers have been developed to automate the dispensing process of viscous products; however, conventional dispensers suffer from several disadvantages, such as, for example, an ineffective dispensing valve. Typically, the tack of the product causes the product to stick to the dispensing valve. Consequently, the product sticks to the dispensing valve, dries out, is wasted, and creates a mess that requires frequent cleaning. Also, the quantity dispensed in conventional dispensers is not adjustable according to user preference. Clearly, people do not always prefer the same amount of product dispensed. In particular, toothpaste dispensers typically dispense an amount of toothpaste proportional to the size of the toothbrush head. Children, in particular, have a need to control the amount of toothpaste dispensed since a strong taste and concentration of the paste may cause the child discomfort or pain.

Thus, it can be clearly recognized that there is a need for an apparatus that allows a user to adjust the quantity of the product discharged according to user preference independent of other considerations, such as the size of a toothbrush. There is also a need for an apparatus that readily deposits the discharged product without leaving the discharged product on the dispenser valve. Additionally, there is a need for an apparatus that prevents sticking of deposited product to the dispensing apparatus so as to reduce waste, maintain a clean dispenser, and permit rapid dispensing of the product for a user.

SUMMARY OF THE INVENTION

The present invention has been developed in response to the present state of the art, and in particular, in response to the problems and needs in the art that have not yet been fully solved by currently available product dispensers. Accordingly, the present invention has been developed to provide an apparatus and system for a product dispenser that overcome many or all of the above-discussed shortcomings in the art.

The apparatus for a dispenser is provided with a plurality of elements configured to functionally execute the necessary steps to dispense. These steps in the described embodiments include opening a gate to dispense a product in response to an actuator slideably connected to a body, wetting the gate with a fluid from a fluid source by way of a nozzle in response to movement of the actuator.

The apparatus, in one embodiment, is configured to provide fluid from a fluid source integrated with the body. In another embodiment, the fluid source is capable of being decoupled from the nozzle.

In a further embodiment, the apparatus comprises a spring connected to the gate by a linkage. A trip member linked to the gate opens the gate and biases the spring in response to movement of the actuator. A release member may cooperate with the trip member to release the spring to close the gate in response to movement of the actuator to a predetermined position. Alternatively, the spring may connect directly to the gate. In another embodiment, the spring may connect to the trip member.

In another embodiment, the apparatus comprises an O-ring within an opening between the gate and the product source. The O-ring may seal the opening in response to closing the gate.

In one embodiment, the apparatus includes a piston configured to discharge the product, a piston arm connected to the piston to slide the piston within a chamber. An adjustment mechanism connected to the piston arm may change the stroke of the piston which changes the volume of the chamber.

In another embodiment, the apparatus further comprises a pump connected to the nozzle. The pump may draw fluid from a fluid source in response to movement of the actuator. The pump drives the fluid through the nozzle to wet the gate and/or a product delivery opening.

In a further embodiment, the apparatus dispenses product through a delivery opening in response to movement of the actuator. The delivery opening may include a gate, an aperture, a valve, an o-ring, and the like.

A system of the present invention is also presented to dispense a product. The system may include a body, an actuator, a nozzle, a fluid source, a piston, and a pump. The actuator may slideably connect to the body. Movement of the actuator may open a gate to dispense the product. Movement of the actuator may also drive the fluid from the fluid source through the nozzle to wet the gate. Movement of the actuator may also drive the piston to discharge the product. In one embodiment, the actuator drives a pump that pumps the fluid through the nozzle.

In certain embodiments, the system may comprise elements substantially similar to the elements of the apparatus described above. The system my also include an adjustment mechanism linked to the piston, wherein the adjustment mechanism is configured to adjust the amount of product dispensed.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
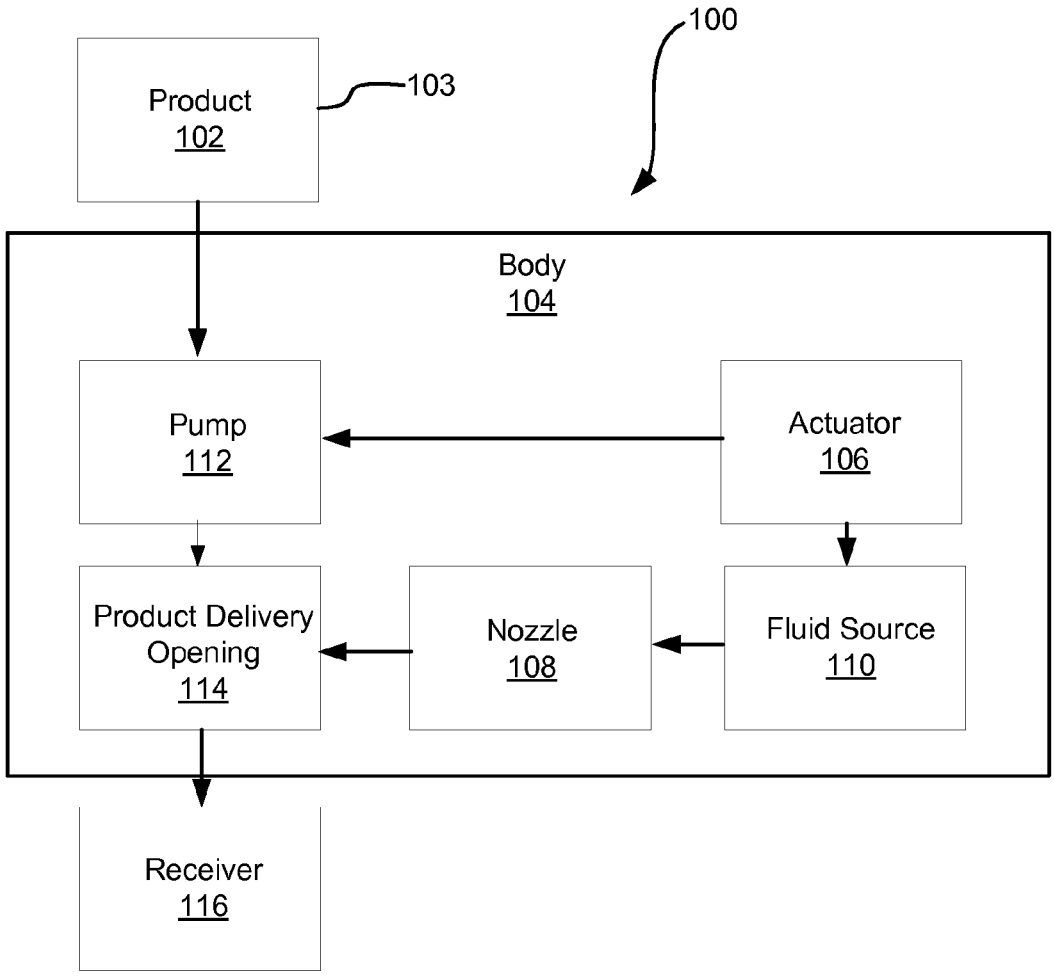
FIG. 1 is a schematic block diagram illustrating one embodiment of a dispenser in accordance with the present invention.

FIG. 1 depicts a schematic block diagram of a dispenser 100 according to one embodiment of the present invention. The dispenser 100 holds product 102 within a product source 103. The product 102 may comprise any fluid with higher viscosity than water. Examples of products 102 include toothpaste, liquid soap, mayonnaise, ketchup, mustard, and the like. The dispenser 100 includes a body 104, an actuator 106, a nozzle 108, and a fluid source 110. The body 104 houses the actuator 106, the nozzle 108, and optionally the fluid source 110.

The body 104 may be formed from any rigid material such as plastic or metal. In one embodiment, the body 104 may be shaped as a box. In another embodiment, the body 104 may be formed into a decorative shape, such as the head of an animal. In yet another embodiment, the body 104 is designed with slip-resistant feet.

Movement of the actuator 106 may activate a pump 112 to discharge product 102 through a product delivery opening 114. Movement of the actuator 106 also drives fluid from the fluid source 110 through the nozzle 108 to wet the product delivery opening 114. Wetting the product delivery opening 114 lubricates the product delivery opening 114 to facilitate the release of product 102 from the product delivery opening 114. The product 102 is delivered to a receiver 116 such as a toothbrush, a food item, or the like.

The actuator 106 may be made of any rigid material such as plastic or metal. In one embodiment, the actuator 106 may be slideably connected to the body in a track such that the actuator 106 can slide from an initial position to a second position. The actuator 106 may further be configured to automatically return to the initial position.

The pump 112 moves product 102 from the product source 103 through the product delivery opening 114. The pump 112 may comprise a piston pump, with a piston slideably inserted into a chamber, an entry valve, and an exit valve. In this embodiment, as the piston slides to expand the chamber, the entry valve opens and product 102 is drawn into the chamber. As the piston compresses the chamber, the exit valve opens, the entry valve closes, and the product 102 in the chamber is discharged through the exit valve to the product delivery opening 114.

As will be appreciated by those skilled in the art, a variety of types and configurations of pumps 112 can be utilized without departing from the scope and spirit of the present invention. For example, in one embodiment, the product pump 112 may comprise a screw pump. In another embodiment, the product pump 112 may comprise opposing rollers that compress the product source 103.

The nozzle 108 wets the product delivery opening 114 with fluid provided from the fluid source 110. The nozzle 108 may wet the product delivery opening 114 by spraying fluid through a fine opening, such as the nozzle of a squirt gun. In another embodiment, the nozzle 108 may wet the product delivery opening 114 by dripping fluid onto the product delivery opening 114.

The fluid source 110 contains a fluid and is coupled to the nozzle 108. The fluid source 110 can be made of any impermeable material, such as plastic, metal, or rubber. In one embodiment, the fluid source 110 is integrated with the body 104. In another embodiment, a fastener removeably couples the fluid source 110 to the nozzle 108, such that the fluid source 110 can be removed and replaced. Alternatively, the fluid source 110 is refillable.

Figure 2:
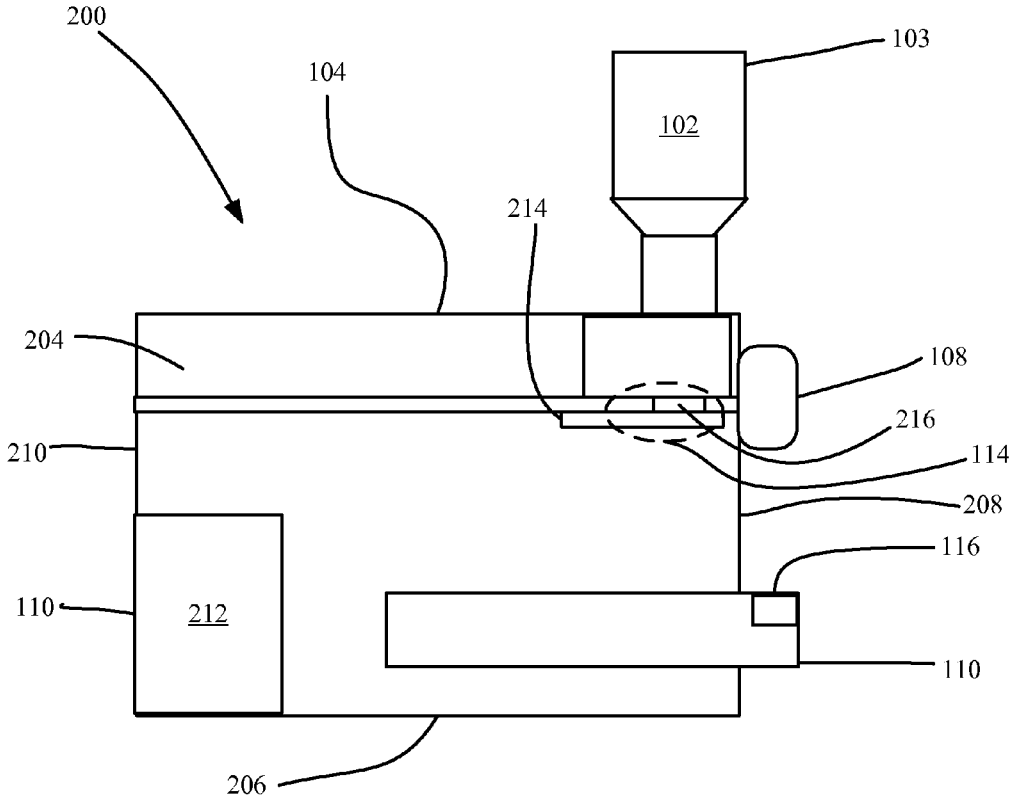
FIG. 2 is a cross-section view illustrating one embodiment of a dispenser in accordance with the present invention.

FIG. 2 illustrates one embodiment of a dispenser 200 with greater specificity. The dispenser 200 dispenses product 102 from the product source 103 through the product opening 114. Preferably, the product source 103 is a standard container and the dispenser 200 is configured to removeably connect the product source 103. For example, the product source 103 may comprise a tube of toothpaste. The dispenser 200 may have threads similar to the cap of a tube of toothpaste such that the tube of toothpaste can be screwed into the dispenser 200. In another embodiment, the dispenser 200 may include an adapter 202 to mate with different thread types and openings on different product sources 103. In another embodiment, the dispenser 200 may mate with a product source 103 such as a tube of toothpaste by friction fitting the open end of the tube with a cone-shaped housing 203 attached to the pump 112.

The body 104 comprises a top 204, a bottom 206, a front 208, a back 210, and two sides (not shown). The body 104 may be formed from any rigid material such as plastic or metal. In one embodiment, the body 104 may be shaped as a box. In another embodiment, the body 104 comprises a curved top 204, bottom 206, front 208, back 210, and sides. In yet another embodiment, the body is designed with slip-resistant feet.

In one embodiment, the actuator 106 protrudes through the front 208 of the body 104 and is slideably connected to the body 104. The actuator 106 may slide in tracks connected to the body 104 that restrict motion of the actuator 106 to lateral motion in one dimension. The actuator 106 may slide through the front 208 of the body 104 from an initial position to a second position. The nozzle 108 is configured to wet the product delivery opening 114 with a fluid 212. In one embodiment, the nozzle 108 is attached to the body 104. In the illustrated embodiment, the nozzle 108 is attached to the body 104 near the product delivery opening 114. The fluid source 110 contains the fluid 212. The body 104 may include an integrated fluid source 110 that is coupled to the nozzle 108.

In another embodiment, the fluid source 110 is removable from the body 104. For example, the fluid source 110 may comprise a removable, replaceable, and/or disposable cartridge containing a fluid 212 for use with the dispenser 200. The fluid 212, in one embodiment, is a liquid with a viscosity similar to water that evaporates quickly such as water, alcohol, mouthwash, and the like.

The product delivery opening 114 comprises a gate 214 and an opening 216. The gate 214 slides in response to movement of the actuator 106. The gate 214 is further configured to close the product delivery opening 114 and interrupt the flow of the product 102.

In another embodiment, the fluid 212 is emitted from the nozzle 108 to wet the gate 214. In other embodiments, the fluid 212 wets other points with which the product 102 may come in contact. An example of these points with which the product may come in contact is the underside of the top 206. Another example is an O-ring (described below) that seals the product delivery opening 114. The fluid on the O-ring lubricates the O-ring to minimize sticking of the product 102 to the O-ring and product delivery opening 114, such that the product keeps the O-ring clean and helps the O-ring form a seal when the product delivery opening 114 is closed.

Figure 3:
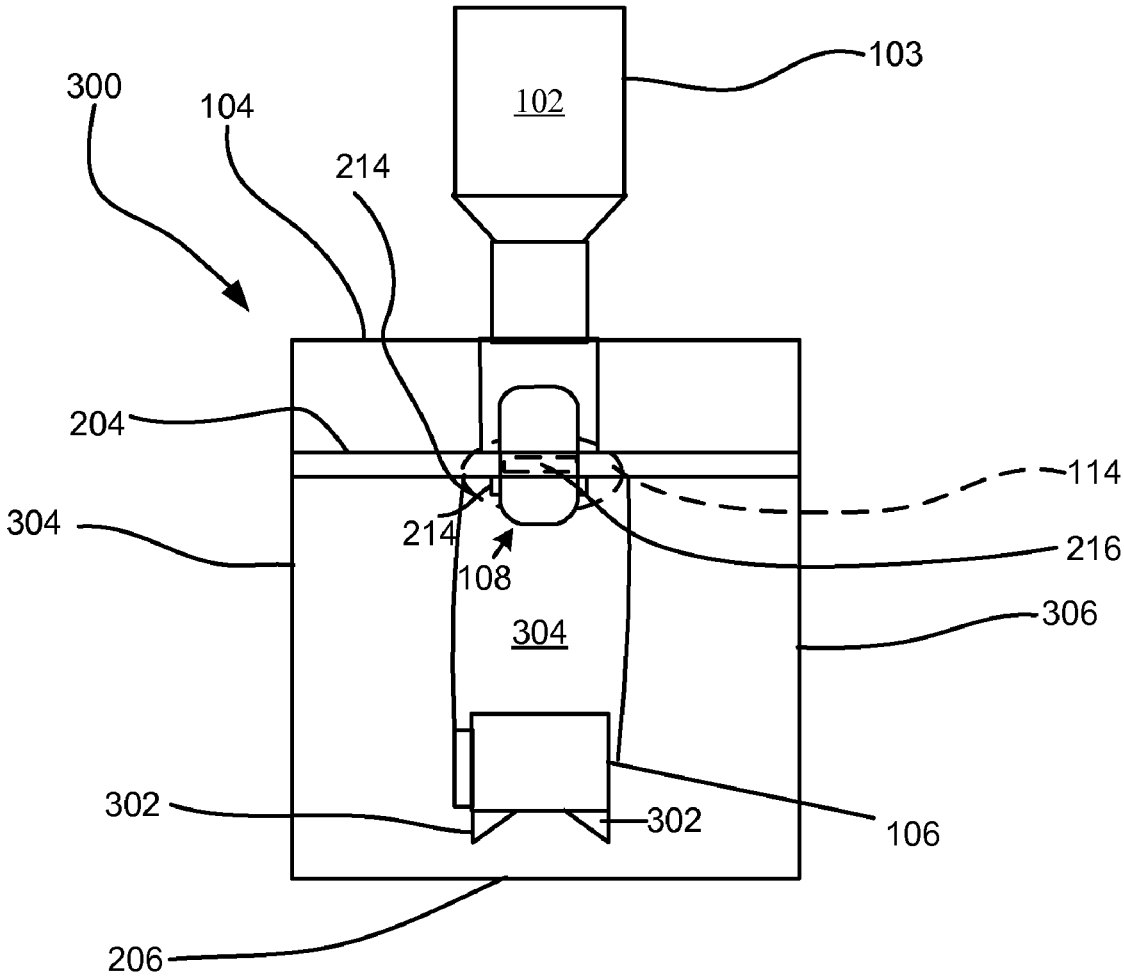
FIG. 3 is a cross-section view illustrating one embodiment of the front of a dispenser in accordance with the present invention.

FIG. 3 illustrates a front cross-section view of one embodiment of a dispenser 300. The dispenser 300 comprises a body 104, a product delivery opening 114, a nozzle 108, an actuator 106, and tracks 302. The dispenser 300 dispenses the product 102 through the product delivery opening 114.

The body comprises a top 204, a bottom 206, a left side 304, a right side 306, a front (not shown) and a back (not shown). The body 104 may be formed from any rigid material such as plastic or metal. In one embodiment, the body 104 may be shaped as a box.

The product delivery opening 114 passes through the top 204 of the body 104 and comprises an opening 216 and a gate 214. The gate 214 slides open and closed in response to movement of the actuator 106. The gate 214 is further configured to close the product delivery opening 114 and interrupt the flow of the product 102.

The nozzle 108 is configured to wet the product delivery opening 114 with fluid in response to movement of the actuator 106. In one embodiment, the nozzle 108 is attached to the front 204 of the body 104 near the product delivery opening 114.

The dispenser 300 may comprise more than one nozzle 108 configured to wet the product delivery opening 114. For example, the dispenser 300 may comprise two nozzles 108 configured to wet the product delivery opening 114 from different angles. The nozzle 108, in an alternative embodiment, may be activated by an initiator independent from the actuator 106, such as a second actuator. In another embodiment, the dispenser 300 includes a first nozzle 108 to wet the product delivery opening 112 and a separate second nozzle 108 to wet the gate 214.

Wetting the product delivery area 114 lubricates the components that come in contact with the product 102 including the gate 214 and the opening 216. This lubrication reduces the amount of product 102 that adheres to these components, and keeps the dispenser 300 clean. The less the product 102 sticks to these components to more readily the product 102 separates from the opening 216 and deposits on the receiver 116.

In the illustrated embodiment, the actuator 106 is slideably connected to the body 104. The actuator 106 may slide in the tracks 302. The tracks 302 are connected to the body 104. The tracks 302 restrict the movement of the actuator 106 to one dimension. In FIG. 3, the actuator 106 slides into and out of the Figure. Other methods of restricting the movement of the actuator 106 to one dimension also considered within the scope of the present invention will be obvious to one skilled in the art, such as a channel surrounding the actuator 106 and connected to the body 104.

Preferably, the body 104 includes a cavity 304 configured to accept the sliding actuator 106 and the receiver 116. The cavity 304 may be sized to accommodate receivers 116 such as a toothbrush without impeding dispensing of the product 102. The cavity 304 may be rectangular or circular shaped.

Figure 4:
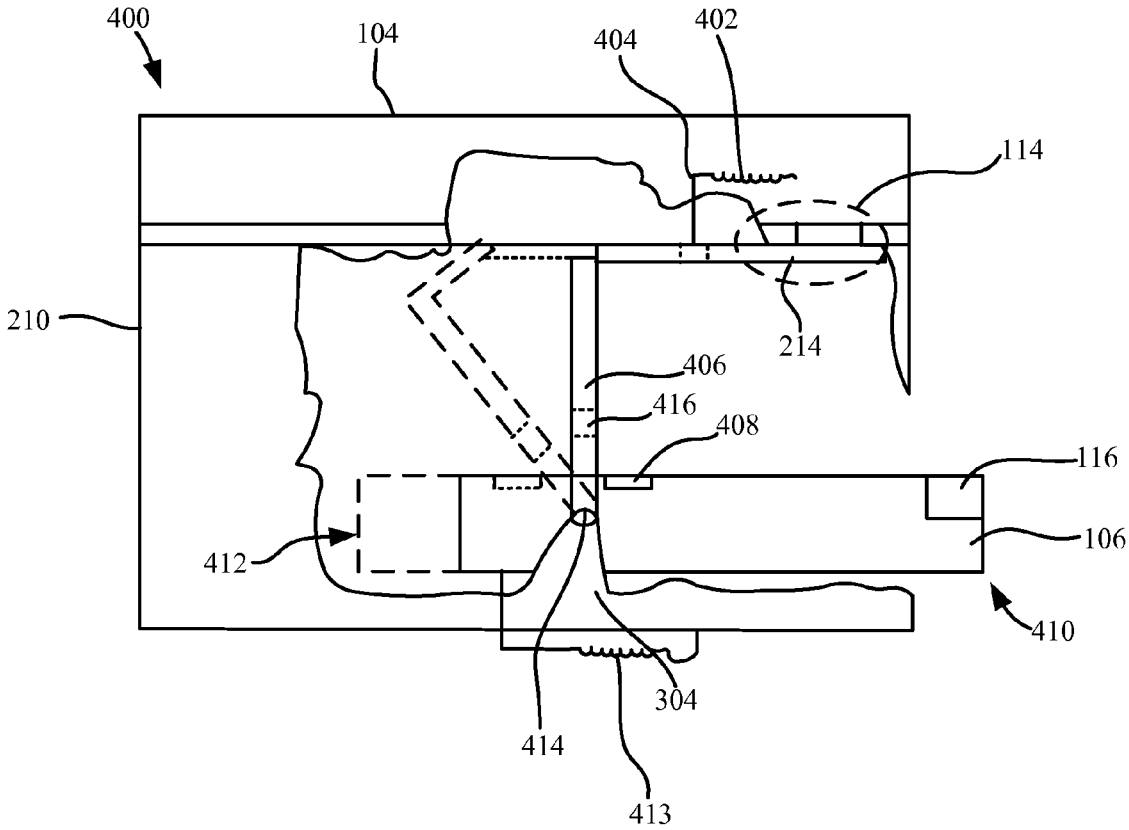
FIG. 4 is a side cut-away view illustrating elements for opening and closing a product opening in accordance with the present invention.

FIG. 4 illustrates a side cut-away view of a dispenser 400 to highlight the actuator 106, the motion of the actuator 106 within the body 104, a spring 402 connected to a spring linkage 404 connected to the gate 214, a trip member 406 connected to the body 104, and a release member 408 connected to the actuator 106.

The actuator 106 is slideably connected to the body 104. The actuator 106 moves from an initial position 410, as illustrated by the solid lines, to a second position 412, as illustrated by the phantom lines. Preferably, the actuator 106 remains in the initial position 410 unless acted upon by a receiver 116. A spring force, discussed in more detail in relation to FIG. 9 below may retain the actuator 106 in the initial position 410. Preferably, the spring force is configured such that a user can readily move the actuator 106 into the body 104 for example with a toothbrush placed in the receiver 116.

In one embodiment, an actuator spring 413 may automatically return the actuator 106 to the initial position 410. The actuator spring 413 is connected to the actuator 106 and the body 104. As the actuator 106 slides from the initial position 410, the actuator spring 413 is biased. When the actuator 106 is released, the biased actuator spring 413 returns the actuator 106 to the initial position 410.

The trip member 406 may be rotatably connected to the body 104 at a trip member connection point 414, and can be constructed from a rigid material, such as metal or plastic and may comprise various type of pivoting fasteners including pins, screws, hinges, and the like. The trip member 406 rotates around the trip member connection point 414 from a first position, as illustrated by the solid lines, to a second position, as illustrated by the phantom lines, in response to movement of the actuator 106. Movement of the actuator 106 towards the second position 412 cases the actuator 106 slide against the trip member 406 and push the trip member towards the back 210 of the body 104. As the trip member 406 rotates, it pulls the gate 208 open. Rotation of the trip member 406 may also bias the spring 402.

The linkage 404 may connect to the spring 402 and the gate 214. The linkage 404 may be made from any rigid or elastic material, such as metal or plastic and may comprise a pin, a screw, a set screw, and the like. In this embodiment, the linkage 404 biases the spring 402 in response to the gate 214 sliding open.

The spring 402 is connected to the body 104 and the linkage 404. The spring 402 may comprise any elastic material, such as a coil spring or a rubber or elastic band. The spring 402 is deformed under tension from the linkage 404.

The release member 408 is connected to the actuator 106. In one embodiment, the release member 408 is a part of the actuator 106. Alternatively, the release member 408 may be connected to the actuator 106 with a fastener such as glue or a plastic weld.

The release member 408 engages with the trip member 406 in response to movement of the actuator 106, and forces the trip member 406 to rotate. When the actuator 106 reaches the second position 412, the release member 408 releases the trip member 406, and the biased spring 402 quickly returns the gate 214 to an initial position that closes the product delivery opening 114. More specifically, in one embodiment, the release member 408 slides along the trip member 406 until an opening 416 is reached. The release member 408 passes through the opening 414 and thereby releases the trip member 406. The bias in the spring 402 returns the trip member 406 to its initial position which closes the gate 214. Of course those of skill in the art recognize that the position of the release member 408 on the actuator 106 and the opening 416 on the trip member 406 may be interchanged in different embodiments of the present invention.

The gate 214 is slideably connected to the body 104. In one embodiment, the gate 214 slides within a channel or track (not shown). As the actuator 106 moves from the first position 410 to the second position 412, the gate 214 slides and opens the product delivery opening 114. The gate 214 quickly and smoothly slides to close the product opening 114 when the release member 408 releases the trip member 406. Preferably, the gate 214 closes the product opening 114 quickly in a snap-like manner. The closing gate 214 severs the flow of the dispensed product 102, causing the product to fall cleanly to the receiver 116. Advantageously, the snap-closed action of the trip member 406 and the gate 124 causes products of very high viscosity such as toothpaste, honey, chocolate, syrup, or the like to easily separate from the product opening 114.

Other embodiments of the trip member 406, release member 408, opening 416, and spring 402 will be readily evident to one skilled in the art. For example, in an alternative embodiment, rather than rotating, the trip member 406 may slide laterally with the actuator 106, biasing the spring 402 and pulling the gate 214 to open the product delivery opening 114. Upon the actuator 106 reaching the second position, the release member 408 may retract into the actuator 106 to release the trip member 406, allowing the biased spring 402 to close the gate 214.

Figure 5:
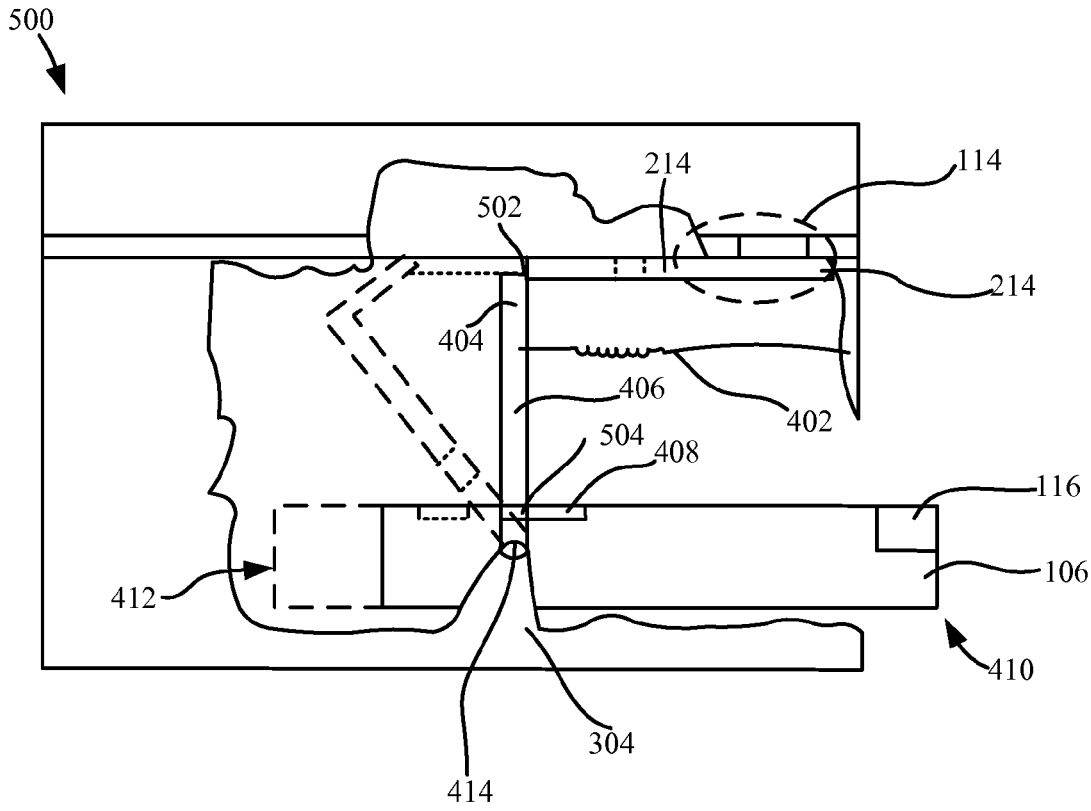
FIG. 5 is a side cut-away view illustrating elements for opening and closing a product opening in accordance with the present invention.

FIG. 5 illustrates a side cut-away view of a dispenser 500 to highlight the actuator 106, the motion of the actuator 106 within the body 104, a spring 402 connected to the trip member 406, the trip member 406 connected to the body 104, and a release member 408 connected to the actuator 106. This alternative embodiment is similar to the embodiment in FIG. 4, except that the spring 402 connects to the trip member 406. In this embodiment, the trip member 406 acts as the spring linkage 404 and transfers the force of the biased spring 400 to the gate 214. The trip member 404 may connect to the gate 214 by way of a hinge 502. Alternatively, the trip member 404 and gate 214 may comprise a single integrated piece.

The actuator 106 is slideably connected to the body 104. In this embodiment, the actuator 106 moves from an initial position 410, as illustrated by the solid lines, to a second position 412, as illustrated by the phantom lines. The actuator 106 can be moved under force from a toothbrush placed in the receiver 116.

A trip member connection point 414 may rotatably connect the trip member 406 to the body 104. The trip member connection point 414 can be constructed from a rigid material, such as metal or plastic. The trip member 406 rotates around the trip member connection point 410 from a first position, as illustrated by the solid lines, to a second position, as illustrated by the phantom lines, in response to movement of the actuator 106. As the trip member 406 rotates, it pulls the gate 214 open. Rotation of the trip member 406 may also bias the spring 402.

The spring 402 is connected to the body 104 and the trip member 406. The spring 402 may comprise any elastic material, such as a coil spring or a rubber or elastic band. The spring 402 is deformed under tension from the linkage 404.

The release member 408 is connected to the actuator 106. In one embodiment, the release member 408 is a part of the actuator 106. Alternatively, the release member 408 may be connected to the actuator 106 with a fastener such as glue or a plastic weld.

The release member 408 engages with the trip member 406 in response to movement of the actuator 106, and forces the trip member 406 to rotate. When the actuator 106 reaches the second position 412, the release member 408 releases the trip member 406, and the biased spring 402 quickly returns the gate 214 to an initial position that closes the product delivery opening 114. More specifically, in one embodiment, the release member 408 comprises a flange 408 extending from the side of the actuator 106. The flange 408 catches tab 504 on the trip member 406 and remains engaged with tab 504 until the actuator 106 reaches the second position 412. When the actuator 106 reaches the second position 412, the tab 504 on the trip member 406 is released. The bias in the spring 402 returns the trip member 406 to its initial position which closes the gate 214. Of course those of skill in the art recognize that the position of the release member 408, the tab 504 on the actuator 106 and the opening 416 on the trip member 406 may be interchanged in different embodiments of the present invention.

The gate 214 is slideably connected to the body 104. In one embodiment, the gate 214 slides within a channel or track (not shown). As the actuator 106 moves from the first position 410 to the second position 412, the gate 214 slides and opens the product delivery opening 114. The gate 214 quickly and smoothly slides to close the product opening 114 when the release member 408 releases the trip member 406. Preferably, the gate 214 closes the product opening 114 quickly in a snap-like manner. The closing gate 214 severs the flow of the dispensed product 102, causing the product to fall cleanly to the receiver 116. Advantageously, the snap-closed action of the trip member 406 and the gate 124 causes products of very high viscosity such as toothpaste, honey, chocolate, syrup, or the like to easily separate from the product opening 114.

Figure 6:
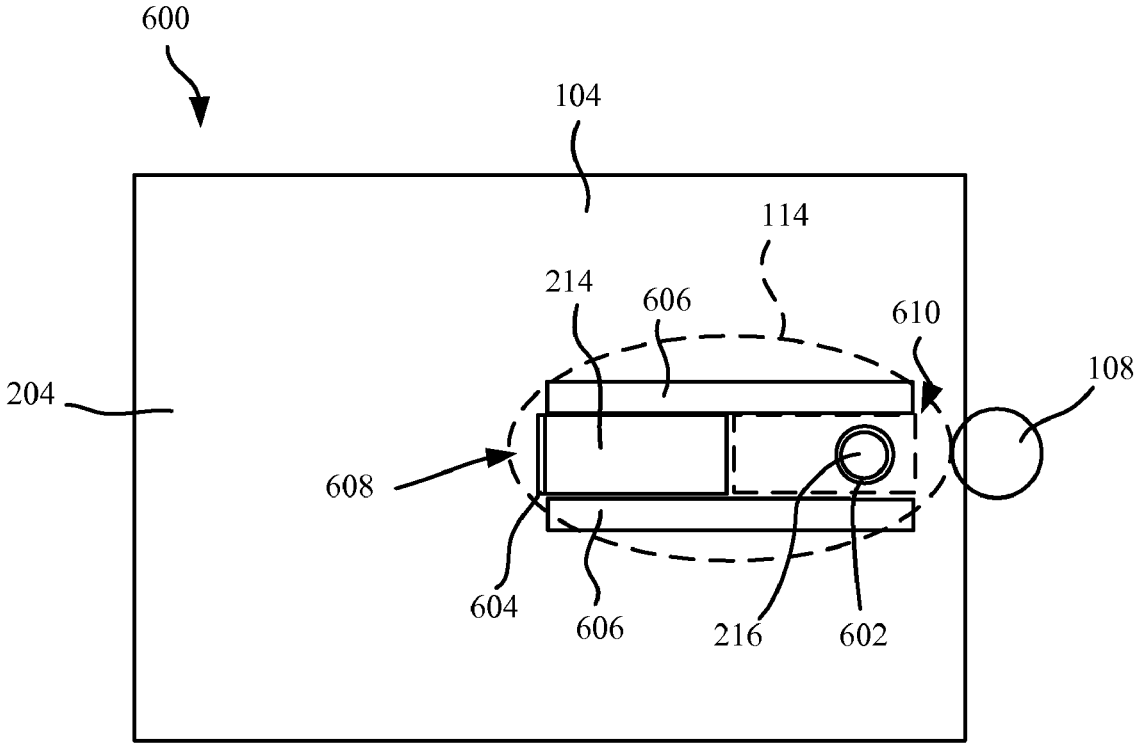
FIG. 6 is a bottom view of one embodiment of the underside of the top of the dispenser in accordance with the present invention.

FIG. 6 illustrates one embodiment of the underside of the top 204 (See FIG. 2) of the body 104 of a dispenser 600. The top 204 comprises a product delivery opening 114, a nozzle 108, an O-ring 602, and a hinge 604. In this embodiment, the product delivery opening 114 comprises the gate 214, the opening 216, and the O-ring 602.

The gate 214 may be made up of a flexible or rigid material, such as plastic or metal, and is slideably connected to the product delivery opening 114. The gate 214 may be configured to travel along rails 606 that restrict the movement of the gate 214 to one dimension. The gate 214 slides from an open position 608, shown by the solid lines, to a closed position 610, shown by the phantom lines. Preferably, the gate 214 is a planar rectangular piece of material of a sufficient thickness to endure repeated sliding along the rails 606 and keep the product 202 from exiting the opening 216 when the gate 214 is closed.

In one embodiment, the gate 214 is connected by a hinge 604 to the trip member 406. The hinge 604 translates the rotary motion of the trip member 406 to linear motion so the gate 214 slides along the rails 606. One skilled in the art will recognize that the hinge 604 between the gate 214 and the trip member 406 (See FIGS. 4 and 5) may comprise rotatable sockets and a pin, or a flexible material, such as plastic, rubber, or the like. In another variation, the entire gate 214 may comprise a flexible material such as plastic or the like connected directly to the trip member 406.

The opening 216 may comprise a hole in the top 204 of the body 104. Product 102 passes through the opening 216 as it is dispensed. The product 102 is pumped through the opening 216 by a pump 112. The pump 112 is discussed in greater detail in FIG. 7A. In one embodiment, the opening 216 circumscribes an O-ring 602. The O-ring 602 serves to seal the opening 216 to prevent escape of product 102 when the gate 214 is closed. The O-ring 602 has a toroidal shape made of pliable material, such as plastic, rubber or the like. The O-ring 602 contacts the gate 214 when the gate 214 is in a closed position, sealing the opening 216. Sealing the opening 216 prevents the product 102 from drying out.

The nozzle 108 wets the product delivery opening 114. The components of the product delivery opening 114 are in regular contact with the product 102 as the dispenser 600 is used, and without wetting, the tack of the product 102 causes a buildup of waste to accumulate on the product delivery opening 114. Wetting the product delivery opening 114 reduces the adhesion of the product 102 to the components in contact with the product 102, and reduces the buildup of waste.

Figure 7A:
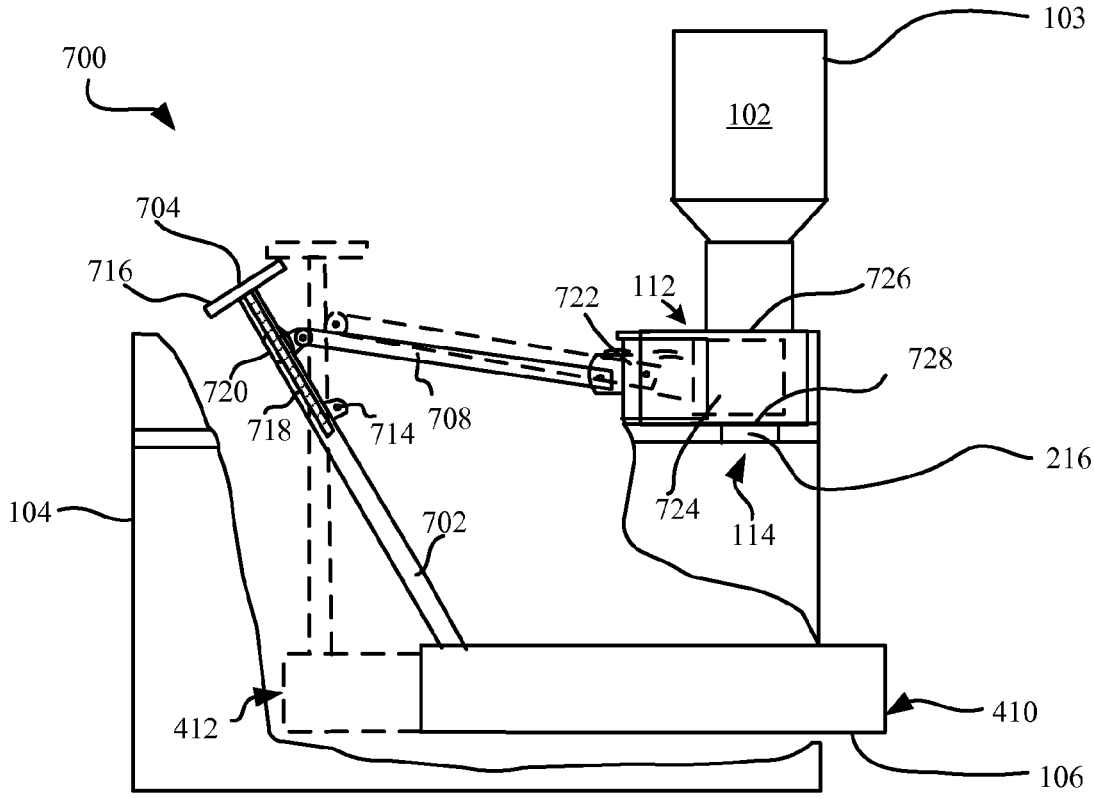
FIG. 7A is a cross-section view illustrating one embodiment of elements for pumping the product in accordance with the present invention.

FIG. 7A illustrates a mechanism for pumping product 102 in one embodiment of a dispenser 700. The dispenser 700 includes an actuator 106, an adjustment arm 702, an adjustment mechanism 704, a piston arm 708, and a pump 112. The actuator 106 operates as described above in relation to FIGS. 1-6. The pump 112 operates as described above in relation to FIG. 1.

The adjustment arm 702 allows the stroke of the pump 112 to be changed which changes the quantity of product 102 dispensed. The adjustment arm 702 may be rotatably connected to the actuator 106. The adjustment arm 702 may be constructed from any rigid material such as metal, plastic, or the like. Movement of the actuator 106 causes the adjustment arm 702 to rotate around a connection point 714. As the actuator 106 moves from its initial position 410 to its second position 412, the adjustment arm 702 rotates from a first position, as illustrated by the solid lines, to a second position, as illustrated by the phantom lines.

The adjustment mechanism 704 modifies the effective length of the adjustment arm 702. In the illustrated embodiment, the adjustment mechanism 704 comprises a knob 716, a screw 718, and a slide 720. The knob 716 is rotatably connected to the adjustment arm 702. The knob 716 can be made from any rigid material such as metal, plastic, or the like. The knob 716 is configured to be freely turned about the longitudinal axis of the adjustment arm 702.

The screw 718 is connected to the knob 716 such that turning the knob 716 also turns the screw 718. The material of the screw 718 is preferably metal, but may also be another material, such as plastic, capable of withstanding the stresses generated by operation of the device 700.

The slide 720 is preferably metal, but may comprise plastic. The slide 720 includes a threaded hole that interfaces with the screw 718. As the knob 716 turns, the screw 718 also turns. As the screw 718 turns, the slide 720 travels along the longitudinal axis of the adjustment arm 702.

The piston arm 708 may connect the slide 720 to a piston 722, and may be any material capable of transferring force from the slide 720 to the piston 722, such as metal, plastic, or the like. The piston arm 708 translates the rotary motion of the adjustment arm 702 about the connection point 714 into linear motion at the piston 722.

The pump 112 comprises the piston 722, a chamber 724, an entry valve 726, and an exit valve 728. The piston 722 is slideably inserted into the chamber 724 and the entry valve 726 and the exit valve 726 are connected to the chamber 724. In this embodiment, as the piston 722 slides to expand the chamber 724, the entry valve 726 opens and product 102 is drawn into the chamber 724. As the piston 722 compresses the chamber 724, the exit valve 728 opens, the entry valve 726 closes, and the product 102 in the chamber 724 is discharged through the exit valve 728 to the product delivery opening 114.

In the illustrated dispenser 700, the adjustment mechanism 704 modifies the amount of product 102 dispensed through the product delivery opening 114. The adjustment mechanism 704 changes the effective length of the adjustment arm 702. As the effective length of the adjustment arm 702 increases, the stroke of the piston 722 within the chamber 724 also increases. As the effective length of the adjustment arm 702 decreases, the stroke of the piston 722 within the chamber 724 also decreases. Changes in the stroke of the piston 722 cause a corresponding change the effective volume of the chamber 724. As the effective volume of the chamber 724 varies, the amount of product 102 discharged through the product delivery opening 114 varies a corresponding amount.

As will be appreciated by those skilled in the art, a variety of types and configurations of adjustment mechanism 704 can be utilized without departing from the scope and spirit of the present invention. For example, in one embodiment a slide 720 freely moveable on the adjustment arm 702 is held in place by a set screw. In another embodiment, the slide 720 is fixed to the adjustment arm 702, and the adjustment mechanism 704 modifies the length of the adjustment arm 702.

Figure 7B:
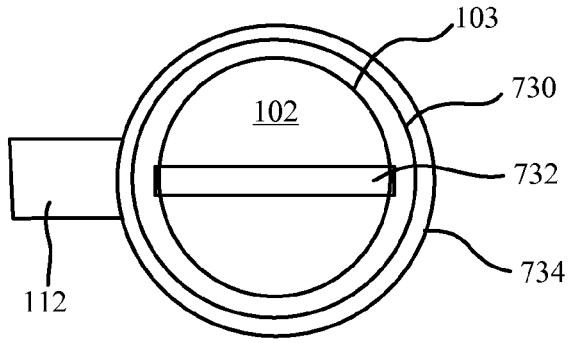
FIG. 7B is a top cross-section view illustrating one embodiment of elements for product handling in accordance with the present invention.

FIG. 7B illustrates another embodiment of the dispenser 700, the pump 112 additionally comprises a pump assist plate 730 and a product source cover 734.

The pump assist plate 730 moves product 102 in the product source 103 to the pump 112. The pump assist plate 730 comprises a plate with a slot 732. The product source 103 slides through the slot 732 in the pump assist plate 730 as product 102 is dispensed. As the pump assist plate 730 slides down the product source 103, the walls of the product source 103 are compressed and product 102 is forced to the pump 112. The pump assist plate 730 is manually moved toward the pump 112.

Variations of the pump assist plate 730 within the scope of the present invention will be apparent to an expert in the field. In one embodiment, the pump assist plate 730 with a mechanical linkage to the actuator 106 that automatically compresses the walls of the product source 103 as product 102 is dispensed. In another embodiment, the pump assist plate 730 is electrically actuated.

The product source cover 734 covers the product source 103. The product source cover 734 comprises a removable cylinder that mates with the dispenser 700 configured to contain the product source 103 and the pump assist plate 730. The product source cover 734 keeps the product source 103 out of view and improves the aesthetic appearance of the dispenser 700.

The schematic flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 8:
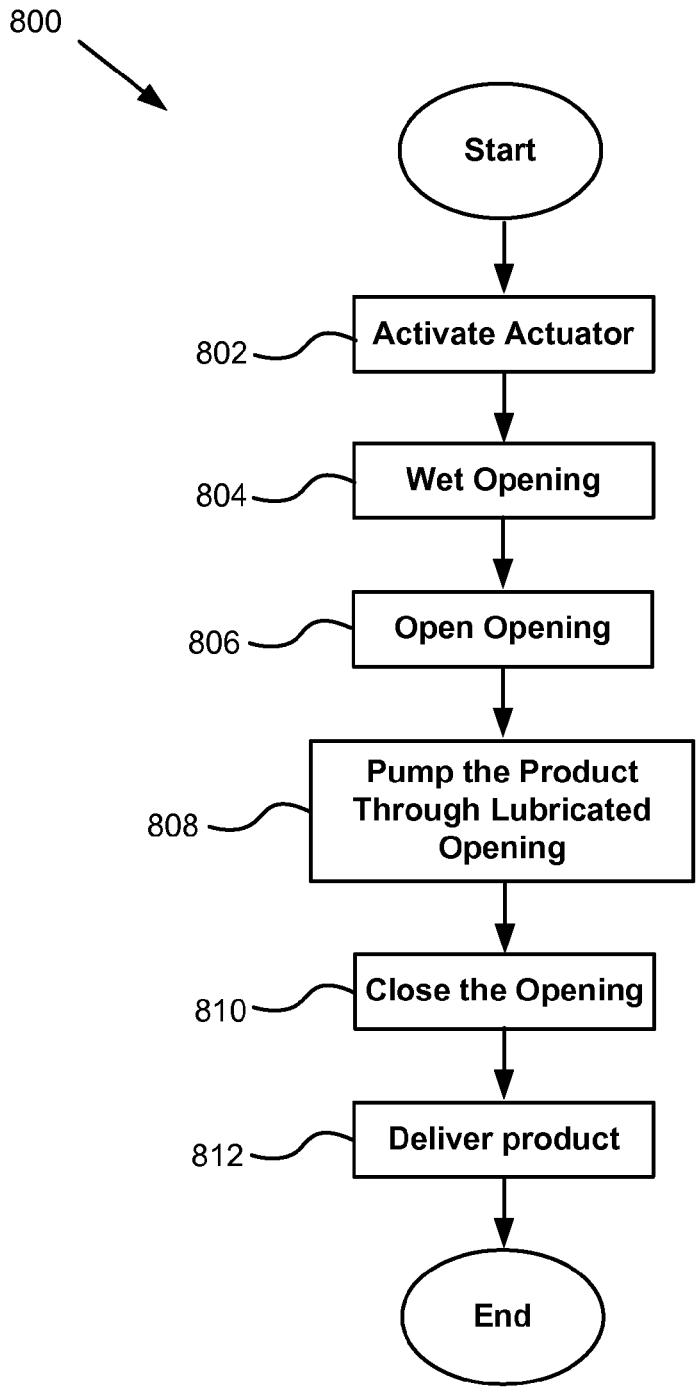
FIG. 8 is a flow chart illustrating one embodiment of dispensing a product in accordance with the present invention.

FIG. 8 depicts a flow chart for a method 800 for dispensing product 102. The method consists of steps to activate 802 the actuator 106, wet 804 the product delivery opening 114, open 806 the product delivery opening 114, pump 808 the product 102 through the lubricated opening 114, close 810 the product delivery opening 114, and deliver 810 the product 102.

Initially, the user activates 802 the actuator 106. The user may activate 802 the actuator 106 by applying force to the actuator 106 with a toothbrush. In another embodiment, the user may activate 802 the actuator 106 by pressing a button (not shown).

Next, the dispenser wets 804 the product delivery opening 114. The dispenser may wet the product delivery opening 114 with water, mouthwash, or the like. Wetting 804 the product delivery opening 114 reduces the amount of product 102 that sticks to the product delivery opening 114 during the dispensing process. Wetting 804 allows for a clean separation between the product delivery opening 114 and the product 102.

Next, the dispenser opens 806 the product delivery opening 114. Typically, the dispenser opens 806 the product delivery opening 114 by way of a mechanical linkage (see FIG. 9) to the actuator 106. In another embodiment, the product delivery opening 114 is opened 806 with an electric motor.

Next, the dispenser pumps 808 the product 102 through the product delivery opening 114. In one embodiment, the dispenser pumps 808 the product 102 with a piston pump 112. As will be appreciated by those skilled in the art, a variety of types and configurations for pumping 808 can be utilized without departing from the scope and spirit of the present invention. For example, in one embodiment, the product 102 is pumped by a screw pump. In another embodiment, the dispenser pumps 808 product with an electric pump.

Next, the dispenser closes 810 the product delivery opening 114. Closing 810 the product delivery opening 114 serves to sever the flow of the product 102 and seal the product 102 to keep it fresh for future use. Preferably, the closing step 810 is performed rapidly to facilitate separation of the product 102 from the product delivery opening 114. The product delivery opening 114 may be closed 810 by a sliding gate 214 made from metal or plastic mechanically connected to the actuator 106. The product delivery opening 114 may include an O-ring 602 that seals the opening. In another embodiment, the product delivery opening 114 may be closed 810 by an electric solenoid.

Finally, the dispenser delivers 812 the product 102. The product 102 may be delivered 812 via gravity when the dispenser closes 810 the product delivery opening 114 and severs the flow of the product 102. When the flow of the product 102 is severed, the product 102 does not stick to the lubricated product delivery opening 114, and falls onto the receiver 116.

Figure 9:
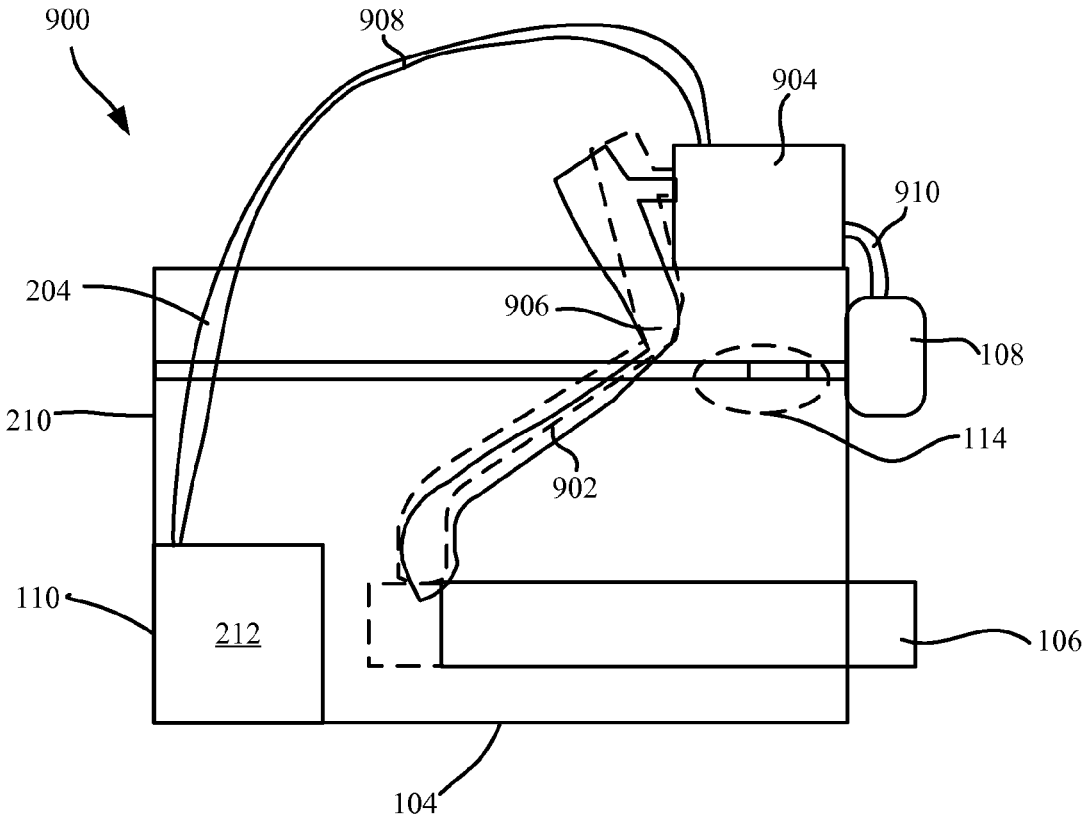
FIG. 9 is a cross-section view illustrating one embodiment of a dispenser in accordance with the present invention.

FIG. 9 illustrates one embodiment of the wetting elements of a dispenser 900. The dispenser 900 includes the actuator 106, a fluid pump linkage 902, a fluid pump 904, a fluid source 110, and a nozzle 108.

The fluid pump linkage 902 transfers lateral movement of the actuator 106 to the fluid pump 904. The fluid pump linkage 902 may be made from a rigid material such as metal, plastic, or the like. In one embodiment, the fluid pump linkage 902 rotates about a connection point 906 connected to the body 104. The connection point 906 may comprise a pin, axle, screw, of the like.

In response to movement of the actuator 106, the fluid pump linkage 902 rotates about the connection point 906 from a first position, as illustrated by the solid lines, to a second position, as indicated by the phantom lines.

The fluid pump 904 delivers fluid 212 to the nozzle 108. In one embodiment, the fluid pump 904 draws fluid 212 through a feed tube 908 from a fluid source 110 and delivers fluid 212 through a delivery tube 910 to the nozzle 108. The fluid pump 904 may comprise a piston pump. In certain embodiments, the feed tube 908 and/or delivery tube 910 may be integrated into the body 104 as channels or the like.

As will be appreciated by those skilled in the art, a variety of types and configurations of fluid pump 904 can be utilized without departing from the scope and spirit of the present invention. For example, in one embodiment the fluid pump 904 comprises the pumping mechanism of a squirt gun. In another embodiment, the fluid pump 904 comprises an electric diaphragm pump. In yet another embodiment, the fluid pump 904 may comprise a bellows pump.

The fluid source 110 contains a fluid 212 and is coupled to the nozzle 108 through the feed tube 908, the fluid pump 904, and the delivery tube 910. The fluid source 110 can be made of any impermeable material, such as plastic, metal, or rubber. In one embodiment, the fluid source 110 is integrated with the body 104. In another embodiment, a fastener (not shown) removeably couples the fluid source 110 to the nozzle 108, such that the fluid source 110 can be removed and replaced. Alternatively, the fluid source 110 includes a reclosable opening that permits a user to refill the fluid source 110.

The nozzle 108 wets the product delivery opening 114 with fluid provided from the fluid source 110 through the fluid pump 904. The nozzle 108 may wet the product delivery opening 114 by spraying fluid through a fine opening, such as the nozzle of a squirt gun. In another embodiment, the nozzle 108 may wet the product delivery opening 114 by dripping fluid onto the product delivery opening 114.

Figure 10:
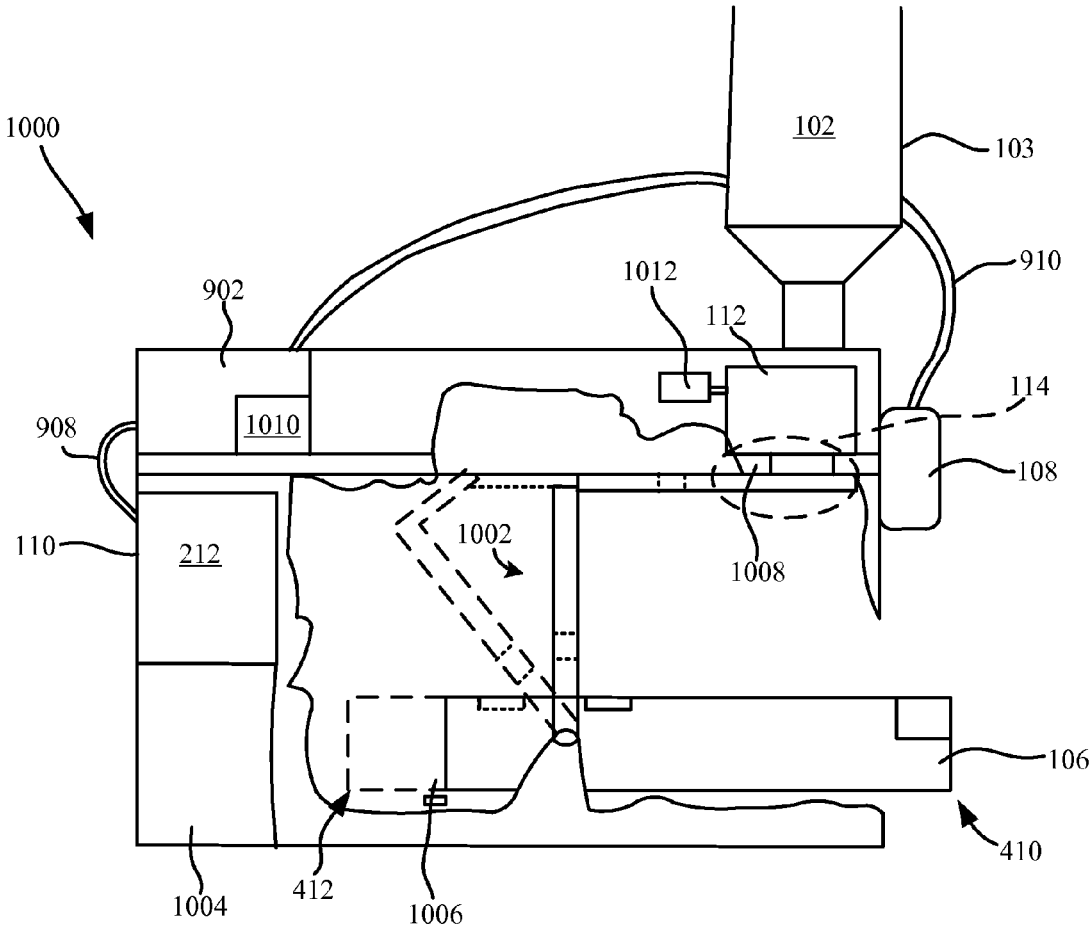
FIG. 10 is a side cut-away view illustrating one embodiment of a dispenser in accordance with the present invention.

FIG. 10 illustrates one embodiment of a dispenser 1000 configured for operation using electricity. The dispenser 1000 comprises a body 104, an actuator 106, a product 102, a product source 103, a pump 112, a product delivery opening 114, a product opening and closing mechanism 1002, a fluid source 110, a fluid pump 902, a nozzle 108, a feed tube 908, a delivery tube 910, a power supply 1004, a fluid switch 1006, and a product switch 1008.

In this embodiment, the body 104, the actuator 106, and the product delivery opening 114 are substantially similar to those components described in relation to FIG. 5. The opening and closing mechanism 1002 comprises elements substantially similar to those discussed in relation to FIG. 5. The pump 112, product 102, and product source 103 may be substantially similar to like components described in relation to FIG. 7A. The fluid source 110, nozzle 108, feed tube 908 and delivery tube 910 may be substantially similar to like numbered components described in relation to FIG. 9.

In this embodiment the fluid pump 902 draws fluid 212 from the fluid source 110 and delivers the fluid 212 to the nozzle 108. The fluid pump 902 may include an electric motor 1010 driven and activated by the fluid switch 1006. The fluid pump 902 may comprise the electric motor 1010 driving an impeller.

The fluid switch 1006 activates the fluid pump 902. The fluid switch 1006 may comprise a switch connected to the body 104 near the actuator 106, and configured to activate the fluid pump 902 as the actuator 106 moves from a first position 410 to a second position 412. Activation of the fluid pump 902 wets the product delivery opening 114. Wetting the product delivery opening 114 facilitates separation of the product 102 and reduces buildup of product 102 on the dispenser 1000.

The pump 112 draws product 102 from the product source 103 and delivers the product 102 through the product delivery opening 114. The pump 112 is electrically activated and may comprise a piston driven by a solenoid 1012.

As will be appreciated by those skilled in the art, a variety of types and configurations of electrical devices to pump the product 102 can be utilized without departing from the scope and spirit of the present invention. For example, in one embodiment the pump 112 comprises a screw drive operated by an electric motor. In another embodiment the pump 112 comprises rollers configured to squeeze the product source 103.

The product switch 1008 activates the pump 112. The product switch 1008 may comprise a switch connected to the body 104 near the product delivery opening 114 configured to activate the pump 112 when the product delivery opening 114 is open. The product switch 1008 may be further configured to deactivate the pump 112 when the product delivery area 114 is closed.

As will be appreciated by those skilled in the art, a variety of types and configurations of product switch 1008 can be utilized without departing from the scope and spirit of the present invention. For example, in one embodiment, the product switch 1008 is connected to the body 104 near the actuator 106 and configured to activate the pump 112 in response to the position of the actuator 106.

The power source 1004 provides power to the electrical components of the dispenser 1000. The power source 1004 may comprise batteries in electrical communication, such as wires, with the pump 112 and the fluid pump 902. The electrical communication of the power source 1004 with the electrical components of the dispenser 1000 may be controlled by the product switch 1008 and the fluid switch 1006.

One skilled in the art will recognize variations of the power source 1004 that are within the scope of the present invention. For example, the power source 1004 may comprise a connection for external power, such as a household wall socket.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A dispenser comprising:
a body;
a product delivery opening;
an actuator, slideably connected to the body, and configured to open a gate to dispense a product, the gate configured to slide open laterally in one dimension to allow the product to pass through the product delivery opening;
a nozzle configured to wet the gate and the product delivery opening with a fluid in response to movement of the actuator; and
a fluid source coupled to the nozzle, wherein movement of the actuator substantially simultaneously drives fluid from the fluid source through the nozzle and opens the gate to dispense the product.

2. The dispenser according to claim 1, wherein the fluid source is integrated with the body.

3. The dispenser according to claim 1 wherein the fluid source is removably coupled to the nozzle.

4. The dispenser according to claim 1, further comprising:
a spring connected to the gate by a linkage;
a trip member, linked to the gate and configured to open the gate and bias the spring in response to movement of the actuator; and
a release member configured to release the biased spring to close the gate in response to the movement of the actuator to a predetermined position.

5. The dispenser according to claim 4 further comprising an O-ring within an opening between the gate and a product source, the O-ring is configured to seal the opening in response to closing the gate.

6. The dispenser according to claim 1, further comprising:
a piston configured to discharge the product;
a piston arm, connected to the piston, and configured to slide the piston within a chamber;
an adjustment mechanism connected to the piston arm, the adjustment mechanism configured to change the stroke of the piston to change the effective volume of the chamber.

7. An apparatus configured to dispense a product, comprising:
a body;
an actuator, slideably connected to the body, and configured to slide open a product delivery opening, the actuator configured to slide laterally in one dimension;
a nozzle connected to the body and configured to wet the product delivery opening with a fluid in response to movement of the actuator;
a fluid source coupled to the nozzle; and
a fluid pump connected to the actuator, the fluid pump configured to draw fluid from the fluid source and drive the fluid through the nozzle in response to movement of the actuator, wherein movement of the actuator substantially simultaneously operates the fluid pump to drive the fluid from the fluid source through the nozzle and opens the gate to dispense the product.

8. The apparatus according to claim 7, wherein the fluid source is integrated with the body.

9. The apparatus according to claim 7 wherein the fluid source is removably coupled to the nozzle.

10. The apparatus according to claim 7, further comprising:

a spring connected to a gate by a linkage;

a trip member, connected to the gate by a hinge and configured to open the gate and bias the spring in response to movement of the actuator; and a release member configured to release the biased spring to close the gate in response to the movement of the actuator to a predetermined position.

11. The apparatus according to claim 10 wherein the spring is connected to the trip member.

12. The apparatus according to claim 7, further comprising:

a piston configured to discharge the product;

a piston arm, connected to the piston and configured to slide the piston within a chamber;

an adjustment mechanism, connected to the piston arm, the adjustment mechanism configured to change the stroke of the piston to change the effective volume of the chamber.

13. A system for dispensing a product comprising:

a body;

an actuator, slideably connected to the body, and configured to open a gate to dispense a product, the gate configured to slide open laterally in one dimension;

a nozzle configured to wet the gate and a product delivery opening with fluid in response to movement of the actuator;

a fluid source coupled to the nozzle;

a piston pump connected to the actuator such that movement of the actuator causes the piston pump to discharge the product, the piston pump comprising;

a piston slidably inserted into a chamber, the piston being slidable to compress and expand the chamber;

an entry valve communicable in fluid communication with the chamber, the entry valve configured to receive the product, wherein the product is drawn into the chamber through the entry valve as the piston is withdrawn to expand the chamber; and an exit valve communicable in fluid communication with a product delivery opening, wherein the exit valve opens as the piston slides to compress the chamber, wherein the piston is configured to discharge the product through the exit valve and the product delivery opening; and a fluid pump configured to draw fluid from the fluid source and deliver the fluid to the nozzle, the fluid pump connected to the actuator and configured to drive fluid through the nozzle in response to movement of the actuator such that movement of the actuator substantially simultaneously operates the fluid pump and the piston pump.

14. The system according to claim 13, wherein the fluid source is integrated with the body.

15. The system according to claim 13, wherein the fluid source is removably coupled to the nozzle.

16. The system according to claim 13, further comprising:

a trip member, linked to the gate and configured to open the gate in response to movement of the actuator;

a spring connected to the gate by a linkage, the spring configured to be biased by the movement of the actuator; and a release member configured to release the spring in response to the movement of the actuator to a predetermined position such that the gate is closed.

17. The system according to claim 16 wherein the spring is connected to the gate.

18. The system according to claim 13, further comprising an adjustment mechanism linked to the piston pump, wherein the adjustment mechanism is configured to adjust the amount of product dispensed.

* * * * *